United States Patent [19]

Nakaso et al.

[11] Patent Number: 4,548,644

[45] Date of Patent: Oct. 22, 1985

[54] ELECTROLESS COPPER DEPOSITION SOLUTION

[75] Inventors: Akishi Nakaso, Oyama; Kiyoshi Yamanoi, Shimodate; Toshiro Okamura, Shimodate; Yoshiyuki Tsuru, Shimodate, all of Japan

[73] Assignee: Hitachi Chemical Company, Ltd., Tokyo, Japan

[21] Appl. No.: 535,057

[22] Filed: Sep. 23, 1983

[30] Foreign Application Priority Data

Sep. 28, 1982 [JP] Japan ..... 57-169250
Sep. 28, 1982 [JP] Japan ..... 57-169251

[51] Int. Cl.[4] ..... C23C 3/02
[52] U.S. Cl. ..... 106/1.23; 106/1.26
[58] Field of Search ..... 106/1.23, 1.26; 427/437

[56] References Cited

U.S. PATENT DOCUMENTS

| | | | |
|---|---|---|---|
| 3,095,309 | 6/1963 | Zeblisky et al. | 427/443.1 |
| 3,607,317 | 9/1971 | Schneble | 427/443.1 |
| 4,099,974 | 7/1978 | Morishita et al. | 106/1.23 |
| 4,303,443 | 12/1981 | Miyazawa et al. | 106/1.23 |

*Primary Examiner*—Lorenzo B. Hayes
*Attorney, Agent, or Firm*—Antonelli, Terry & Wands

[57] ABSTRACT

An electroless copper deposition solution comprising (a) cupric ions, a complexing agent for cupric ions, a reducing agent and a pH adjusting agent, (b) a polyoxyethylene ether and (c) at least one member selected from the group consisting of an inorganic cyanide and $\alpha,\alpha'$-dipyridyl can give a deposited film with high elongation.

12 Claims, No Drawings

ELECTROLESS COPPER DEPOSITION SOLUTION

This invention relates to an electroless copper deposition solution capable of forming a deposited film with high elongation.

In the manufacture of printed wiring boards, an electroless copper deposition solution is used for forming conductors on insulating substrates. Formation of conductors on insulating substrates by the use of an electroless copper deposition solution is currently conducted mainly by the following two processes.

In one process called the full additive process, a plating resist is coated on non-conductor parts of an insulating substrate and the insulating substrate is immersed in an electroless copper deposition solution, whereby conductors of an electroless deposited copper film are formed on parts of the insulating substrate not coated with the plating resist. In another process called the semi-additive process, an insulating substrate is immersed in an electroless copper deposition solution to form a thin electroless copper deposition film on the whole surface of the insulating substrate; a plating resist is coated on non-conductor parts of the resulting substrate; electroplating of copper is effected to form an electrodeposited copper film on parts free of the plating resist; the plating resist is removed and further the thin electroless deposited copper film at the parts where the electrodeposited copper film is not formed is removed by quick etching; thereby conductors are formed.

These electroless copper deposition solutions are composed of a cupric salt such as cupric sulfate, an alkali-soluble complexing agent for cupric ions such as ethylenediaminetetraacetic acid, a reducing agent such as formaldehyde and a pH-adjusting agent which is an alkali hydroxide. Deposited films obtained therefrom are generally brittle. In order to improve this drawback, proposals have been made wherein various additives such as $\alpha,\alpha'$-dipyridyl, 1,10-orthophenanthroline, an inorganic cyanide and a polyalkylene glycol are added to the above solutions. However, no sufficient improvement has been achieved yet.

For example, U.S. Pat. No. 3,095,309 discloses an electroless copper deposition solution to which an inorganic cyanide is added. However, mere addition of an inorganic cyanide does not sufficiently improve the elongation of the deposited film.

Also, U.S. Pat. No. 3,607,317 discloses an electroless copper deposition solution to which an inorganic cyanide and a polyalkylene oxide are added. This addition of an inorganic cyanide and a polyalkylene oxide does not sufficiently improve the elongation of the deposited film, either. Further, because the polyalkylene oxide added has little surface activity, there are formed at times places not wetted by the plating solution, on the surface to be plated, whereby the deposited film becomes non-uniform. In order to prevent this, the polyalkylene oxide is added in an increased quantity, however, it is disadvantageous from an economical point of view. Furthermore, the effect of its combined use with an inorganic cyanide is obtained only when the polyalkylene oxide has a molecular weight of 10,000 to several millions.

Further, U.S. Pat. No. 4,099,974 discloses an electroless copper deposition solution to which $\alpha,\alpha'$-dipyridyl and a polyethylene glycol are added for improving the elongation of the deposited film. In this solution, in order to obtain a uniform deposited film with a good elongation, the polyethylene glycol should be used in a large quantity because the polyethylene glycol has little surface activity. In addition, the high elongation of the deposited film can be obtained only when a high plating temperature is used and the plating solution has a high pH of 12.5 to 13.0. This imposes restrictions on insulating substrates to be used. For example, phenolic paper-base laminates which can be punched out at normal temperatures and are used for low-price printed circuit boards, cannot be applied to the above deposition solution.

An object of this invention is to provide an electroless copper deposition solution capable of forming a deposited film with high elongation.

This invention provides an electroless copper deposition solution comprising:

(a) cupric ions, a complexing agent for these cupric ions, a reducing agent and a pH-adjusting agent, (b) a polyoxyethylene ether of the formula:

$$R_1O—CH_2CH_2O)_nR_2$$

wherein $R_1$ and $R_2$ are independently hydrogen, an alkyl group having 1 to 18 carbon atoms or an alkenyl group having 1 to 18 carbon atoms but $R_1$ and $R_2$ cannot be hydrogen at the same time; and n is a positive value of 2 or more, and (c) at least one member selected from the group consisting of an inorganic cyanide and $\alpha,\alpha'$-dipyridyl.

The component (a) of the electroless copper deposition solution according to this invention is the same as those used in conventional electroless copper deposition solutions and comprises the following compounds.

The cupric ions can be supplied by organic and inorganic cupric salts alone or as a mixture thereof, for example, cupric sulfate, cupric nitrate, cupric chloride, cupric bromide, cupric acetate and the like.

The complexing agent for these cupric ions is a compound which can react with cupric ions to form complexes soluble in aqueous alkali solutions. Typical examples of the complexing agent are ethylenediaminetetraacetic acid, sodium salt thereof, Rochelle salts, N,N,N',N'-tetrakis-(2-hydroxypropyl)-ethylenediamine, triethanolamine, ethylenenitrilotetraethanol, etc.

As the reducing agent, there can be used formaldehyde, paraformaldehyde, etc.

As the pH-adjusting agent, alkali hydroxides such as sodium hydroxide, potassium hydroxide and the like can be used.

It is preferable that the electroless copper deposition solution of this invention has a basic composition comprising 5 to 15 g/l. of cupric sulfate (pentahydrate), 15 to 60 g/l. of ethylenediaminetetraacetic acid as a complexing agent and 2 to 20 ml/l. of 37% aqueous formaldehyde solution as a reducing agent, and adjusted to pH 11.6 to 13.0 and being used at a plating solution temperature of 60° to 80° C.

The polyoxyethylene ether of the component (b) is a polyoxyethylene monoether or polyoxyethylene diether represented by the general formula:

$$R_1O13\ CH_2CH_2O)_nR_2 \qquad (I)$$

wherein $R_1$ and $R_2$ are independently hydrogen, an alkyl group having 1 to 18 carbon atoms or an alkenyl group having 1 to 18 carbon atoms (a monovalent group derived from an alkene group) but $R_1$ and $R_2$ cannot be hydrogen at the same time. These polyoxyethylene ethers have surface activity because the $(CH_2CH_2O)_n$ moiety of their molecules is hydrophilic and the $R_1$ moiety or both of $R_1$ and $R_2$ moieties are hydrophobic although the hydrophobicity differs depending on the carbon atom numbers in the above specified range. The mark "n" in the general formula (I) is preferably 2 to 200, more preferably 4 to 150 and most preferably 10 to 120.

The carbon atom numbers of $R_1$ and $R_2$ are preferably 1 to 10 because the inhibitory action for plating rate becomes small, and more preferably 1 to 4 because, in addition to this advantage, foaming tendency becomes low when continuous aeration is applied for stabilization of the plating solution.

As the polyoxyethylene ether, there can be used, for example, a polyoxyethylene monomethyl ether of the formula:

$$CH_3(OCH_2CH_2)_nOH$$

having a molecular weight (number average molecular weight—the same definition will be applied hereinafter) of 900, 2000 or 5000, a polyoxyethylene dimethyl ether of the formula:

$$CH_3(OCH_2CH_2)_nOCH_3$$

having a molecular weight of 400, a polyoxyethylene methyl allyl ether of the formula:

$$CH_3(OCH_2CH_2)_nOCH_2CHCH_2$$

having a molecular weight of 800, a polyoxyethylene monooleyl ether of the formula:

$$CH_3(CH_2)_7CHCH(CH_2)_8(OCH_2CH_2)_nOH$$

having a molecular weight of 800 or 1000.

These polyoxyethylene ethers can be available commercially, for example, from WAKO PURE CHEMICAL INDUSTRIES, LTD. (Japan), TOKYO KASEI KOGYO CO., LTD. (Japan) and ALDRICH CHEMICAL CO. (U.S.A). These compounds can also be commercially available from many oils and fats manufactures; for example, NIPPON OILS AND FATS CO., LTD. (Japan) markets polyoxyethylene monoethers under a trade name of UNIOX M series and polyoxyethylene diethers under trade names of UNIOX MM series and UNIOX MA series.

Polyoxyethylene ethers can be used alone or as a mixture thereof.

The concentration of polyoxyethylene ethers is preferably 0.1 g/l. or higher and more preferably 0.5 g/l. or higher. The concentration of 1 g/l. or higher gives the best result probably because this concentration provides a sufficient quantity of the polyoxyethylene ether at the surface to be deposited. Since no further improvement of the elongation is obtained by addition of too large a quantity of the polyoxyethylene ether, the upper limit of its addition is preferably 5 g/l. from the economical standpoint but this compound may be added up to its solubility limit.

As the component (c), there can be used at least one member selected from the group consisting of inorganic cyanides and $\alpha,\alpha'$-dipyridyl.

When an inorganic cyanide is used as the component (c), not only the deposited film with high elongation is resulted, but also an electroless copper deposition solution can be used at a wide pH range of, for example, 11.5 to 13.0 whereby the use of phenolic paper-base laminates which can be punched out at normal temperatures becomes possible. However, these meritorious effects and advantages can be obtained only when the component (b) and the component (c) are used in combination, and these cannot be obtained when the component (b) is not used and only the component (c) is used.

As the inorganic cyanide, there can be used sodium cyanide (NaCN), potassium cyanide (KCN), nickel cyanide (NiCN), cobalt cyanide ($Co(CN)_2$), sodium ferrocyanide ($Na_4[Fe(CN)_6]$), potassium ferrocyanide ($K_4[Fe(CN)_6]$), sodium ferricyanide ($Na_3[Fe(CN)_6]$), potassium ferricyanide ($K_3[Fe(CN)_6]$), potassium nickel cyanide ($K_2NI(CN)_6$), sodium nitroprusside ($Na_2Fe(CN)_5(NO)$) and the like. These compounds can be used alone or as a mixture thereof.

The concentration of the inorganic cyanide is preferably 5 to 100 mg/l. When the concentration is lower than 5 mg/l. or higher than 100 mg/l., no deposited film with a sufficiently high elongation is obtained. The concentration is more preferably 6 to 60 mg/l. and most preferably 10 to 30 mg/l.

When $\alpha,\alpha'$-dipyridyl is used as the component (c), not only a deposited film with high elongation is obtained, but also the elongation of a deposited film obtained from the deposition solution is not lowered even if the solution is used for a long period of time such as, for example, 20 to 30 hours or longer. However, these meritorious effects and advantages can be obtained only when the component (b) and the component (c) are used in combination, and these cannot be obtained when the component (b) is not used and only the component (c) is used.

The concentration of $\alpha,\alpha'$-dipyridyl is preferably 5 to 300 mg/l. When it is lower than 5 mg/l., no deposited film with a sufficiently satisfactory and high elongation can be obtained. When the concentration is higher than 300 mg/l., the plating rate is reduced disadvantageously. The concentration is more preferably 10 to 150 mg/l. and most preferably 15 to 50 mg/l .

When an inorganic cyanide and $\alpha$, $\alpha'$-dipyridyl are used together as the component (c), not only a deposited film with high elongation is obtained, but also an electroless copper deposition solution can be used at a wide pH range of, for example, 11.5 to 13.0 and further the elongation of a deposited film obtained from the deposition solution is not lowered, even if the solution is used for a long period of time such as, for example, 20 to 30 hours or longer. However, these meritorious effects and advantages can be obtained only when the component (b) and the component (c) are used in combination and they can not be obtained when the component (b) is not used and only the component (c) is used.

When $\alpha,\alpha'$-dipyridyl and an inorganic cyanide are used in combination as the component (c), the concentration of $\alpha,\alpha'$-dipyridyl is preferably 5 to 300 mg/l., more preferably 10 to 150 mg/l. and most preferably 15 to 50 mg/l. and the concentration of the inorganic cyanide is preferably 0.05 to 5 mg/l., more preferably 0.1 to 3 mg/l. and most preferably 0.2 to 2 mg/l.

As described above, by the use of a small quantity of an inorganic cyanide which is toxic in addition to $\alpha,\alpha'$-dipyridyl, a deposited film with high elongation can be obtained at a wide pH range of the electroless copper deposition solution of 11.5 to 13.0 and also even phenolic paper-base laminates which can be punched out at normal temperatures can be used. Further, since the cyanide is used at a low concentration, the reaction rate between cyan ions and other components of the plating solution is low and consequently the rate of accumulation of the resulting reaction products in the plating solution is low and accordingly there is little fear that the merit of cyanide addition is reduced.

This invention is illustrated by way of the following Examples.

EXAMPLE 1

A basic electroless copper deposition solution was prepared from 10 g/l. of cupric sulfate (pentahydrate), 45 g/l. of ethylenediaminetetraacetic acid and 3.5 ml/l. of 37% formaldehyde solution. To this basic solution were added two kinds of additives, namely, an inorganic cyanide and a polyoxyethylene ether, in the following three different combinations.

| Inorganic cyanide | | Polyoxyethylene ether | |
|---|---|---|---|
| 1. Sodium cyanide | 20 mg/l. | Polyoxyethylene monomethyl ether (M.W. 900, UNIOX M 900, manufactured by NIPPON OILS AND FATS CO., LTD.) | 2 g/l. |
| 2. Sodium ferrocyanide | 30 mg/l. | Polyoxyethylene monooleyl ether (M.W. 1000, manufactured by TOKYO KASEI CO., LTD.) | 1 g/l. |
| 3. Sodium syanide | 20 mg/l. | Polyoxyethylene monomethyl ether (M.W. 2000, UNIOX M 2000, manufactured by NIPPON OILS AND FATS CO., LTD.) | 2 g/l. |

The resulting three solutions were adjusted to respective pHs of 12.0, 12.3 and 12.0 at 20° C., whereby three kinds of electroless copper deposition solutions were produced.

In each of these plating solutions was immersed a stainless steel plate which had been subjected to treatment with a catalyst for the plating reaction, and plating was conducted at a plating solution temperature of 70° C. to form a deposited film having a thickness of 25 to 35 μm. The plating rate, the elongation rate of deposited film and the appearance of deposited film were shown in Table 1.

The elongation rate of deposited film was measured as follows:

A deposited film was peeled off from a stainless steel plate, and cut into a size of 10 mm wide and 100 mm long for giving a test piece for tensile tests. The test piece was subjected to the tensile test at a cross head speed of 1 mm/min and a gaze length of 15 mm by the use of a tensile tester (TENSILON/UTM-1-5000BW, manufactured by TOYO BALDWIN CO., LTD. (Japan)).

COMPARATIVE EXAMPLE 1

To the same basic electroless copper deposition solution as used in Example 1 was added 20 mg/l. of sodium cyanide. The resulting solution was adjusted to a pH of 12.0 at 20° C. to obtain an electroless copper deposition solution. A plating film was formed in the same manner as described in Example 1. The plating rate, the elongation rate of deposited film and the appearance of deposited film were shown in Table 1.

COMPARATIVE EXAMPLE 2

To the same basic electroless copper deposition solution as used in Example 1 was added 1 g/l. of a polyoxyethylene monomethyl ether (M.W. 2000, UNIOX M 2000, manufactured by NIPPON OILS AND FATS CO., LTD.). The resulting solution was adjusted to a pH of 12.6 at 20° C. to obtain an electroless copper deposition solution. A deposited film was formed in the same manner as described in Example 1. The plating rate, the elongation rate of deposited film and the appearance of deposited film were shown in Table 1.

COMPARATIVE EXAMPLE 3

To the same basic electroless copper deposition solution as shown in Example 1 were added 30 mg/l. of α,α'-dipyridyl and 1 g/l., 1 g/l. and 10 g/l. of polyethylene glycol (M.W. 600) manufactured by WAKO PURE CHEMICAL INDUSTRIES, LTD., to obtain three kinds of solutions. These solutions were adjusted to respective pHs of 12.0, 12.6 and 12.6 at 20° C. to obtain three kinds of electroless copper deposition solutions. In each solution, a deposited film was formed in the same manner as described in Example 1. The plating rate, the elongation rate of deposited film and the appearance of deposited film were shown in Table 1.

COMPARATIVE EXAMPLE 4

To the same basic electroless copper deposition solution as shown in Example 1 were added 30 mg/l. of sodium cyanide and 1 g/l. of a polyethylene glycol (M.W. 600, manufactured by WAKO PURE CHEMICAL INDUSTRIES, LTD.). The resulting solution was adjusted to a pH of 12.0 at 20° C. to obtain an electroless copper deposition solution. A deposited film was formed in the same manner as described in Example 1. The plating rate, the elongation rate of deposited film and the appearance of deposited film were shown in Table 1.

EXAMPLE 2

A basic electroless copper deposition solution was prepared from 10 g/l. of cupric sulfate (pentahydrate), 45 g/l. of ethyelenediaminetetraacetic acid and 3.5 ml/l. of 37% formaldehyde solution. To this basic solution were added two kinds of additives, namely, α,α'-dipyridyl and a polyoxyethylene ether, in the following three combinations.

| | | | |
|---|---|---|---|
| 1. α,α'-Dipyridyl | 30 mg/l. | Polyoxyethylene monomethyl ether (M.W. 2000, UNIOX M 2000, manufactured by NIPPON OILS AND FATS CO., LTD.) | 2 g/l. |
| 2. α,α'-Dipyridyl | 20 mg/l. | Polyoxyethylene methyl allyl ether (M.W. 800, UNIOX MA 800, manufactured by NIPPON OILS AND FATS CO., LTD.) | 1 g/l. |
| 3. α,α'-Dipyridyl | 40 mg/l. | Polyoxyethylene monooleyl ether (M.W. 700, manufactured by TOKYO KASEI CO., LTD.) | 0.5 g/l. |

The resulting three solutions were adjusted to a pH of 12.6 at 20° C., whereby three kinds of electroless copper deposition solutions were produced.

In each of these plating solutions was immersed a stainless steel plate which had been subjected to treatment with a catalyst for the plating reaction, and plating was conducted at a plating solution temperature of 70° C. to form a deposited film having a thickness of 25 to 35 μm. The plating rate, the elongation rate of deposited film and the appearance of deposited film were shown in Table 2.

The elongation rate of deposited film was measured as follows:

A deposited film was peeled off from a stainless steel plate, and cut into a size of 10 mm wide and 100 mm long for giving a test piece for tensile tests. The test piece was subjected to the tensile test at a cross head speed of 1 mm/min and a gaze length of 15 mm by the use of a tensile tester (TENSILON/UTM-1-5000BW, manufactured by TOYO BALDWIN CO., LTD. (Japan)).

EXAMPLE 3

To the same basic electroless copper deposition solution as used in Example 2 were added 1 mg/l. of sodium cyanide, 30 mg/l. of α,α'-dipyridyl and 2 g/l. of a polyoxyethylene monomethyl ether (M.W. 2000, UNIOX M 2000, manufactured by NIPPON OILS AND FATS CO., LTD.). The resulting solution was adjusted to five levels of pHs, namely, 11.7, 12.0, 12.3, 12.6 and 13.0 at 20° C., whereby five kinds of electroless copper deposition solutions were produced. In each solution, a deposited film was formed in the same manner as described in Example 2.

The plating rate, the elongation rate of deposited film and the appearance of deposited film were shown in Table 2.

COMPARATIVE EXAMPLE 5

To the same basic electroless copper deposition solution as shown in Example 2 was added 20 mg/l. of sodium cyanide. The resulting solution was adjusted to a pH of 12.0 at 20° C. to obtain an electroless copper deposition solution. In the same manner as described in Example 2, a deposited film was formed. The plating rate, the elongation rate of deposited film and the appearance of deposited film were shown in Table 2.

COMPARATIVE EXAMPLE 6

To the same basic electroless copper deposition solution as used in Example 2 was added 30 mg/l. of α,α'-dipyridyl. The resulting solution was adjusted to two levels of pHs, namely, 12.0 and 12.6 at 20° C. to obtain two kinds of electroless copper deposition solutions. In each of these solutions, a deposited film was formed in the same manner as described in Example 2. The plating rate, the elongation rate of deposited film and the appearance of plating film were shown in Table 2.

COMPARATIVE EXAMPLE 7

To the same basic electroless copper deposition solution as used in Example 2 were added 1 mg/l. of sodium cyanide and 30 mg/l. of α,α'-dipyridyl. The resulting solution was adjusted to a pH of 12.0 at 20° C. to obtain an electroless copper deposition solution. In the same manner as described in Example 2, a deposited film was formed. The plating rate, the elongation rate of deposited film and the appearance of deposited film were shown in Table 2.

COMPARATIVE EXAMPLE 8

To the same basic electroless copper deposition solution as used in Example 2 were added 30 mg/l. of α,α'-dipyridyl and 1 g/l. 1 g/l. and 10 g/l. of a polyethylene glycol (M.W. 600) manufactured by WAKO PURE CHEMICAL INDUSTRIES, LTD., to obtain three kinds of solutions. These solutions were adjusted to respective pHs of 12.0, 12.6 and 12.6 at 20° C. to obtain three kinds of electroless copper deposition solutions. In each solution, a deposited film was formed in the same manner as described in Example 2. The plating rate, the elongation rate of deposited film and the appearance of deposited film were shown in Table 2.

COMPARATIVE EXAMPLE 9

To the same basic electroless copper deposition solution as used in Example 2 were added 1 mg/l. of sodium cyanide and 1 g/l. of a polyethylene glycol (M.W. 600) manufactured by WAKO PURE CHEMICAL INDUSTRIES, LTD. The resulting solution was adjusted to a pH of 12.0 at 20° C. to obtain an electroless copper deposition solution. In the same manner as described in Example 2, a deposited film was formed. The plating rate, the elongation rate of deposited film and the appearance of deposited film were shown in Table 2.

COMPARATIVE EXAMPLE 10

To the same basic electroless copper deposition solution as used in Example 2 were added 1 mg/l. of sodium cyanide, 30 mg/l. of α,α'-dipyridyl and 1 g/l. of a polyethylene glycol (M.W. 600) manufactured by WAKO PURE CHEMICAL INDUSTRIES, LTD. The resulting solution was adjusted to a pH of 12.0 at 20° C. to obtain an electroless copper deposition solution. In the same manner as described in Example 2, a deposited film was formed. The plating rate, the elongation rate of deposited film and the appearance of deposited film were shown in Table 2.

TABLE 1

| | Additives | | | | | | | | | | | |
|---|---|---|---|---|---|---|---|---|---|---|---|---|
| | Inorganic cyanide | | α,α'-Dipyridyl | Polyoxyethylene ether | | | Polyethylene glycol | | pH of plating solution | Plating rate | Elongation rate of deposited film, % | Appearance of deposited film |
| | Compound name | mg/l | mg/l | Compound name | M.W. | g/l | M.W. | g/l | | μm/hr | | |
| Example 1 | Sodium cyanide | 20 | — | Polyoxyethylene monomethyl ether | 900 | 2 | — | — | 12.0 | 2.1 | 6 to 10 | High gloss |
| | Sodium ferro-cyanide | 30 | — | Polyoxyethylene monooleyl ether | 1000 | 1 | — | — | 12.3 | 2.4 | 6 to 10 | High gloss |
| | Sodium cyanide | 20 | — | Polyoxyethylene monomethyl ether | 2000 | 2 | — | — | 12.0 | 1.9 | 7 to 11 | High gloss |
| Comparative Example | | | | | | | | | | | | |
| 1 | Sodium | 20 | — | — | — | — | — | — | 12.0 | 2.0 | 3 to 5 | High gloss |

TABLE 1-continued

| | Additives | | | | | | | | | | | |
|---|---|---|---|---|---|---|---|---|---|---|---|---|
| | Inorganic cyanide | | α,α'-Dipyridyl | Polyoxyethylene ether | | | Polyethylene glycol | | pH of plating solution | Plating rate | Elongation rate of deposited film, % | Appearance of deposited film |
| | Compound name | mg/l | mg/l | Compound name | M.W. | g/l | M.W. | g/l | | μm/hr | | |
| | cyanide | | | | | | | | | | | with plating pits |
| 2 | — | — | — | Polyoxyethylene monomethyl ether | 2000 | 1 | — | — | 12.6 | 4.0 | 3 to 5 | No gloss |
| 3 | — | — | 30 | — | — | — | 600 | 1 | 12.0 | 1.4 | 3 to 5 | No gloss with plating pits |
| | — | — | 30 | — | — | — | 600 | 1 | 12.6 | 3.2 | 4 to 7 | High gloss with plating pits |
| | — | — | 30 | — | — | — | 600 | 10 | 12.6 | 3.2 | 7 to 11 | High gloss |
| 4 | Sodium cyanide | 30 | — | — | — | — | 600 | 1 | 12.0 | 1.3 | 3 to 5 | High gloss with plating pits |

Note:
Plating pits: Pin hole-like pits found on deposited film surface where no plating deposition is made.

TABLE 2

| | Additives | | | | | | | | | | | |
|---|---|---|---|---|---|---|---|---|---|---|---|---|
| | Inorganic cyanide | | α,α'-Dipyridyl | Polyoxyethylene ether | | | Polyethylene glycol | | pH of plating solution | Plating rate | Elongation rate of deposited film, % | Appearance of deposited film |
| | Compound name | mg/l | mg/l | Compound name | M.W. | g/l | M.W. | g/l | | μm/hr | | |
| Example 2 | — | — | 30 | Polyoxyethylene monomethyl ether | 2000 | 2 | — | — | 12.6 | 2.8 | 7 to 11 | High gloss |
| | — | — | 20 | Polyoxyethylene methyl allyl ether | 800 | 1 | — | — | 12.6 | 3.3 | 6 to 10 | High gloss |
| | — | — | 40 | Polyoxyethylene monooleyl ether | 700 | 0.5 | — | — | 12.6 | 2.6 | 7 to 11 | High gloss |
| Example 3 | Sodium cyanide | 1 | 30 | Polyoxyethylene monomethyl ether | 2000 | 1 | — | — | 11.7 | 1.2 | 7 to 11 | High gloss |
| | Sodium cyanide | 1 | 30 | Polyoxyethylene monomethyl ether | 2000 | 1 | — | — | 12.0 | 1.8 | 7 to 11 | High gloss |
| | Sodium cyanide | 1 | 30 | Polyoxyethylene monomethyl ether | 2000 | 1 | — | — | 12.3 | 2.5 | 7 to 11 | High gloss |
| | Sodium cyanide | 1 | 30 | Polyoxyethylene monomethyl ether | 2000 | 1 | — | — | 12.6 | 3.0 | 7 to 11 | High gloss |
| | Sodium cyanide | 1 | 30 | Polyoxyethylene monomethyl ether | 2000 | 1 | — | — | 13.0 | 3.5 | 7 to 11 | High gloss |
| Comparative Example | | | | | | | | | | | | |
| 5 | Sodium cyanide | 20 | — | — | — | — | — | — | 12.0 | 2.0 | 3 to 5 | High gloss with plating pits |
| 6 | — | — | 30 | — | — | — | — | — | 12.0 | 1.9 | 2 to 4 | No gloss with plating pits |
| | — | — | 30 | — | — | — | — | — | 12.6 | 4.6 | 3 to 5 | High gloss with plating pits |
| 7 | Sodium cyanide | 1 | 30 | — | — | — | — | — | 12.0 | 1.8 | 3 to 5 | High gloss with plating pits |
| 8 | — | — | 30 | — | — | — | 600 | 1 | 12.0 | 1.4 | 3 to 5 | No gloss with plating pits |
| | — | — | 30 | — | — | — | 600 | 1 | 12.6 | 3.2 | 4 to 7 | High gloss with plating pits |
| | — | — | 30 | — | — | — | 600 | 10 | 12.6 | 3.2 | 7 to 11 | High gloss |
| 9 | Sodium cyanide | 1 | — | — | — | — | 600 | 1 | 12.0 | 1.3 | 3 to 5 | High gloss with plating pits |
| 10 | Sodium cyanide | 1 | 30 | — | — | — | 600 | 1 | 12.0 | 1.3 | 3 to 5 | High gloss with plating pits |

Note
Pits: Pin hole-like pits found on deposited film surface where no plating deposition is made.

What is claimed is:

1. An electroless copper deposition solution comprising (a) cupric ions, a complexing agent for cupric ions, a reducing agent and a pH adjusting agent, (b) a polyoxyethylene ether of the formula:

$R_1O—CH_2CH_2O)_nR_2$ wherein $R_1$ and $R_2$ are independently hydrogen, an alkyl group having 1 to 4 carbon atoms or an alkenyl group having 1 to 4 carbon atoms but $R_1$ and $R_2$ cannot be hydrogen at the same time; and n is 2 or more, and (c) at least one member selected from the group consisting of an inorganic cyanide and $\alpha,\alpha'$-dipyridyl.

2. An electroless copper deposition solution according to claim 1, wherein the component (c) is an inorganic cyanide.

3. An electroless copper deposition solution according to claim 2, wherein the inorganic cyanide is contained in an amount of 5 to 100 mg/l. and the polyoxyethylene ether is contained in an amount of 0.1 gl. or more.

4. An electroless copper deposition solution according to claim 3, wherein the inorganic cyanide is at least one member selected from the group consisting of sodium cyanide, potassium cyanide, sodium ferrocyanide, potassium ferrocyanide, sodium ferricyanide, potassium ferricyanide, potassium nickelcyanide and sodium nitroprusside.

5. An electroless copper deposition solution according to claim 1, wherein the component (c) is $\alpha,\alpha'$-dipyridyl.

6. An electroless copper deposition solution according to claim 5, wherein $\alpha,\alpha'$-dipyridyl is contained in an amunt of 5 to 300 mg/l and the polyoxyethylene ether is contained in an amount of 0.1 g/l or more.

7. An electroless copper deposition solution according to claim 1, wherein the component (c) is a mixture of an inorganic cyanide and $\alpha,\alpha'$-dipyridyl.

8. An electroless copper deposition solution according to claim 7, wherein the inorganic cyanide is contained in an amount of 0.05 to 5 mg/l, $\alpha,\alpha'$-dipyridyl is contained in an amount of 5 to 300 ml/l and the polyoxyethylene ether is contained in an amount of 0.1 g/l or more.

9. An electroless copper deposition solution according to claim 1, wherein the polyoxyethylene ether is a polyoxyethylene monoether or a polyoxyethylene diether.

10. An electroless copper deposition solution according to claim 1, wherein n is 2 to 200.

11. An electroless copper deposition solution according to claim 1, wherein the polyoxyethylene ether is contained in an amount of 0.5 g/l to 5 g/l.

12. An electroless copper deposition solution according to claim 1, wherein said solution has a pH of 11.5 to 13.0.

* * * * *